US011365017B2

(12) United States Patent
English

(10) Patent No.: US 11,365,017 B2
(45) Date of Patent: Jun. 21, 2022

(54) DRAIN SPOUT FOR DRAINING MATERIAL, FROM FIRST BARREL TO SECOND BARREL

(71) Applicant: Jarrod Robin English, Calgary (CA)

(72) Inventor: Jarrod Robin English, Calgary (CA)

( * ) Notice: Subject to any disclaimer, the term of this patent is extended or adjusted under 35 U.S.C. 154(b) by 0 days.

(21) Appl. No.: 17/375,699

(22) Filed: Jul. 14, 2021

(65) Prior Publication Data

US 2022/0033113 A1 Feb. 3, 2022

Related U.S. Application Data

(60) Provisional application No. 63/058,875, filed on Jul. 30, 2020.

(51) Int. Cl.
*B65B 1/06* (2006.01)
*B67C 11/02* (2006.01)

(52) U.S. Cl.
CPC ..... *B65B 1/06* (2013.01); *B67C 11/02* (2013.01)

(58) Field of Classification Search
CPC ..... B65B 1/06; B67C 11/02; B65D 25/40; B65D 47/06; B67D 7/42
USPC ..... 222/566, 568
See application file for complete search history.

(56) References Cited

U.S. PATENT DOCUMENTS 76,030 A * 3/1868 Zinsser ..... B65D 25/48 222/568
438,611 A * 10/1890 Dieterichs ..... B65D 47/061 222/539
554,941 A * 2/1896 Lines ..... B65D 25/48 222/568
1,070,880 A * 8/1913 Draper ..... B65D 47/061 222/539
1,190,802 A * 7/1916 Rosenfeld ..... B65D 47/061 222/539
1,205,666 A * 11/1916 Rosenfeld ..... B65D 47/061 222/539
1,557,451 A * 10/1925 Gibson ..... B67D 3/043 222/539
1,709,325 A * 4/1929 Runser ..... B67D 1/0829 222/505
1,855,373 A * 4/1932 Willumsen ..... B65D 25/40 222/484
1,959,295 A * 5/1934 Van Deerlin ..... B65D 25/50 222/538

(Continued)

*Primary Examiner* — Timothy L Maust
(74) *Attorney, Agent, or Firm* — ATMAC Patent Services Ltd.; Andrew T. MacMillan

(57) ABSTRACT

A drain spout includes a tubular structure with threads on at least a first end for attaching to a small bunghole of a draining barrel. A process of draining material from the draining barrel includes screwing the drain spout into the small bunghole on the draining barrel. The draining barrel is aligned beside a catch barrel with the small bungholes of the barrels on the outsides and the two large bungholes side by side. The draining barrel is tilted with the drain spout towards the catch barrel and lifting the bottom of the draining barrel while inserting the second end of the drain spout into the big bunghole of the catch barrel. The draining barrel is rotated around the drain spout acting as the axis of rotation approximately 180 degrees until the lip of both barrels meet. The draining barrel is leaned back supported by the drain spout while draining.

11 Claims, 9 Drawing Sheets

(56) References Cited

U.S. PATENT DOCUMENTS

| | | | | | |
|---|---|---|---|---|---|
| 2,084,209 | A * | 6/1937 | McIlroy | F16L 58/08 | 285/55 |
| 2,328,020 | A * | 8/1943 | Johnson | B65D 47/061 | 222/520 |
| 2,645,382 | A * | 7/1953 | Plough | B65D 25/38 | 222/189.07 |
| 2,782,967 | A * | 2/1957 | Walker | B65D 47/065 | 222/485 |
| 3,348,528 | A * | 10/1967 | White, Jr. | F28F 9/10 | 122/360 |
| 4,068,689 | A | 1/1978 | Krull | | |
| 4,129,236 | A * | 12/1978 | Wrycraft | B65D 47/14 | 220/320 |
| 4,314,717 | A * | 2/1982 | Bjurman | B05B 15/652 | 285/5 |
| 4,550,862 | A * | 11/1985 | Barker | B65D 41/26 | 222/109 |
| 5,186,358 | A * | 2/1993 | McVay | B67C 11/02 | 141/332 |
| 5,390,964 | A * | 2/1995 | Gray, Jr. | B29C 61/0608 | 138/104 |
| 5,402,835 | A | 4/1995 | Middleton | | |
| 5,415,210 | A | 5/1995 | Hannah | | |
| 5,647,415 | A | 7/1997 | Orders et al. | | |
| 5,924,608 | A * | 7/1999 | Chiu | B65D 25/48 | 222/538 |
| 7,025,733 | B2 * | 4/2006 | McQuaid | A61B 10/0045 | 220/731 |
| 2011/0253751 | A1 * | 10/2011 | Friedman | B67D 7/005 | 222/566 |

* cited by examiner

DRAIN SPOUT FOR DRAINING MATERIAL, FROM FIRST BARREL TO SECOND BARREL

CROSS-REFERENCE TO RELATED APPLICATIONS

This application claims the benefit of priority of U.S. Provisional Application No. 63/058,875 filed Jul. 30, 2020, which is incorporated herein by reference.

BACKGROUND OF THE INVENTION

(1) Field of the Invention

The invention pertains generally to transferring material from one barrel to another barrel. More specifically, the invention relates to a drain spout and related method of utilizing the drain spout for draining liquid materials from a first fifty-five gallon barrel to a second fifty-five gallon barrel.

(2) Description of the Related Art

Recovery of unused product from a barrel is a problem encountered in many trades. Typical approaches to this problem include utilizing pumps, barrel stands, and funnels. However, the pumps need to have power sufficient for a given density of the fluid material to be transferred, the barrel stands are bulky and still need to have people hold up the barrel up for material to drain, and the funnels again require at least two people to hold the barrel upright for a long period of time to drain material into the funnel for transferring to the bottom barrel.

In general, labor costs, people power requirements, and product loss all contribute to higher costs of recycling of barrels and unused product in said barrels.

BRIEF SUMMARY OF THE INVENTION

In current day approaches, there is leftover product in barrels that companies are unable to access. According to an exemplary embodiment of the invention there is disclosed a drain spout that allows companies to recover the lost product, which maximizes efficiency and saves money.

According to an exemplary embodiment of the invention, disclosed is a drain spout including a tubular structure with threads on at least a first end for attaching to a small bunghole of a draining barrel.

According to an exemplary embodiment of the invention, disclosed is a process of draining material from the draining barrel includes screwing the drain spout into the small bunghole on the draining barrel. The process includes aligning the draining barrel beside a catch barrel with the small bungholes of the barrels on the outsides and the two large bungholes side by side. The process further includes tilting the draining barrel with the drain spout towards the catch barrel and lifting the bottom of the draining barrel while inserting the second end of the drain spout into the big bunghole of the catch barrel. The process further includes rotating the draining barrel around the drain spout acting as the axis of rotation approximately 180 degrees until the lip of both barrels meet. The process further includes leaning the draining barrel back supported by the drain spout while draining.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof

DETAILED DESCRIPTION

Figure 1:
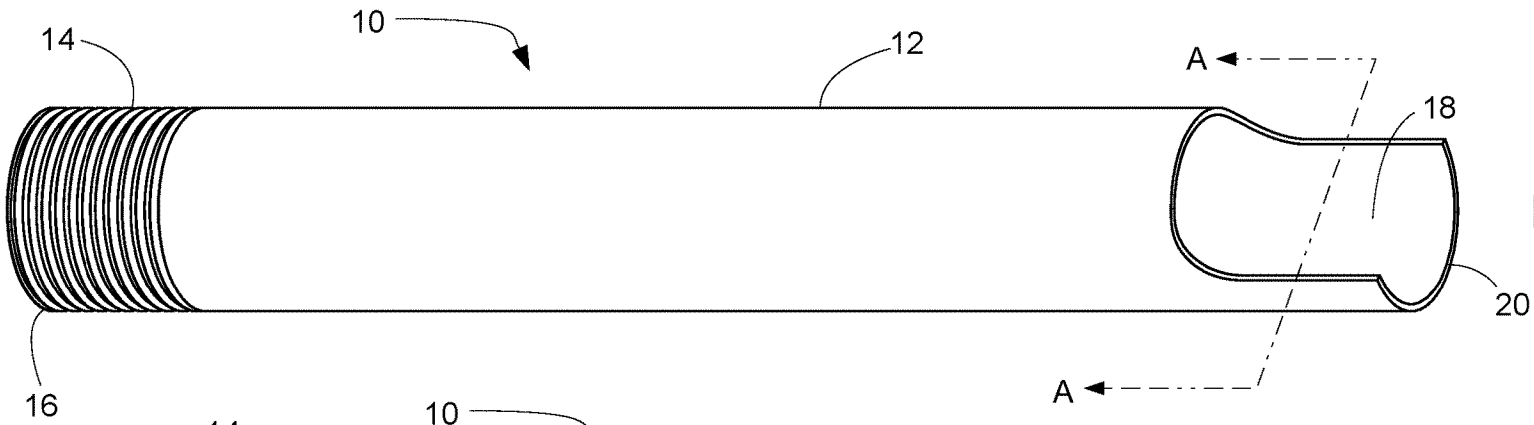
FIG. 1 shows a first perspective view of a drain spout having a notched-out spout according to an exemplary embodiment.
Figure 2:
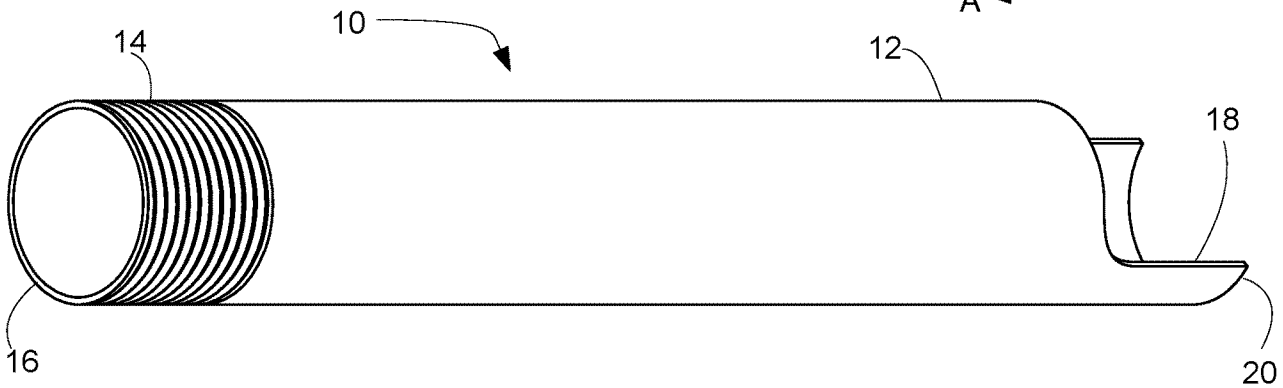
FIG. 2 shows a second perspective view of the drain spout of FIG. 1.
Figure 3:
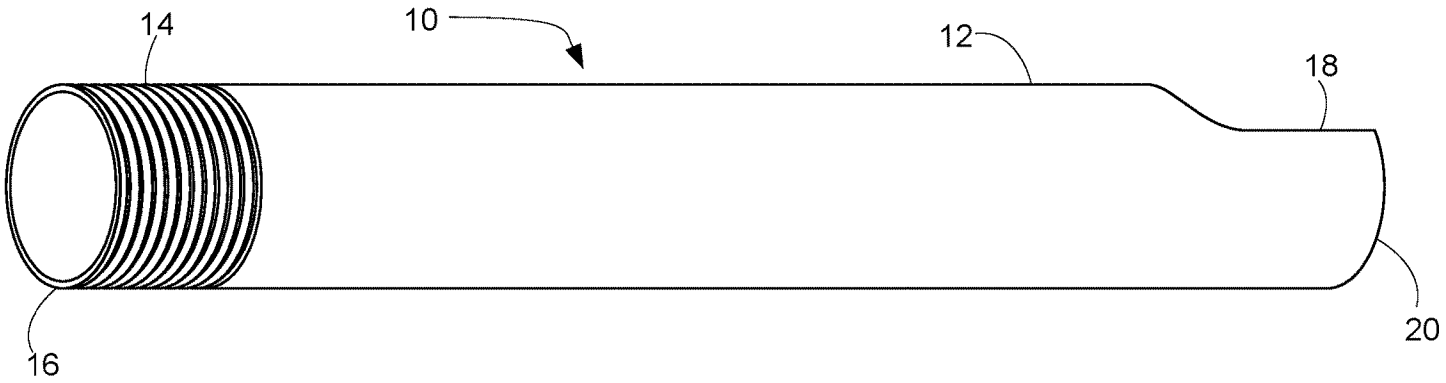
FIG. 3 shows a third perspective view of the drain spout of FIG. 1.
Figure 4:
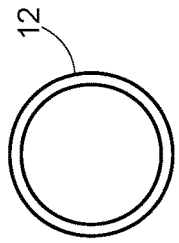
FIG. 4 shows an end view of the drain spout of FIG. 1 taken from the first end.
Figure 5:
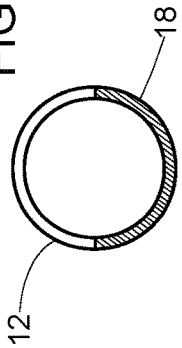
FIG. 5 shows a cross sectional view of the drain spout of FIG. 1 taken along the cut line A-A showing how the spout opening of the tubular body has a C-shape.
Figure 6:
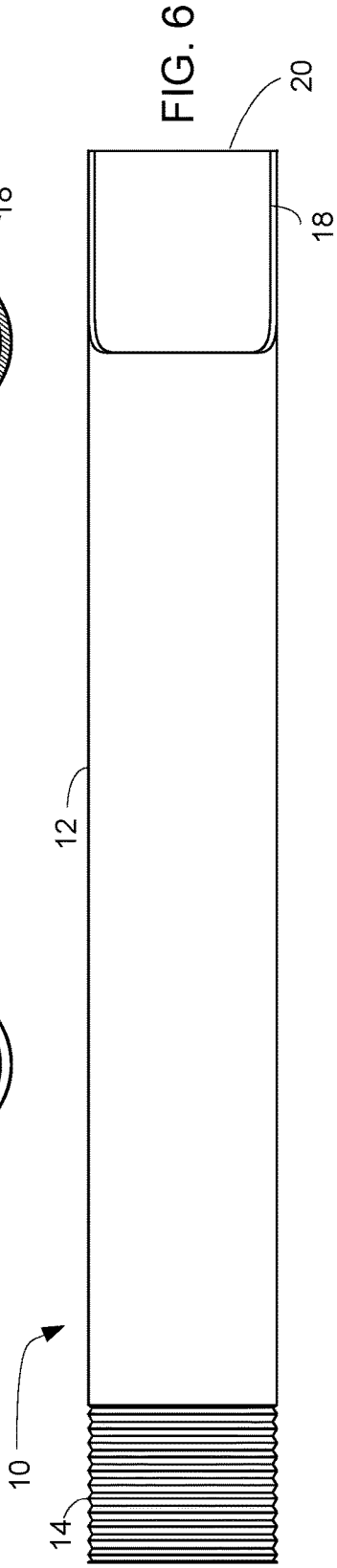
FIG. 6 shows a top view of the drain spout of FIG. 1.
Figure 7:
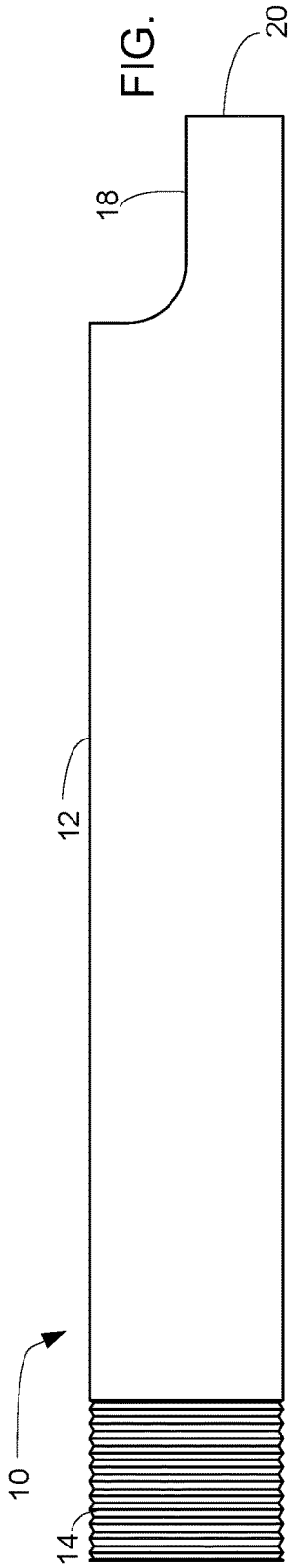
FIG. 7 shows a side view of the drain spout of FIG. 1.
Figure 8:
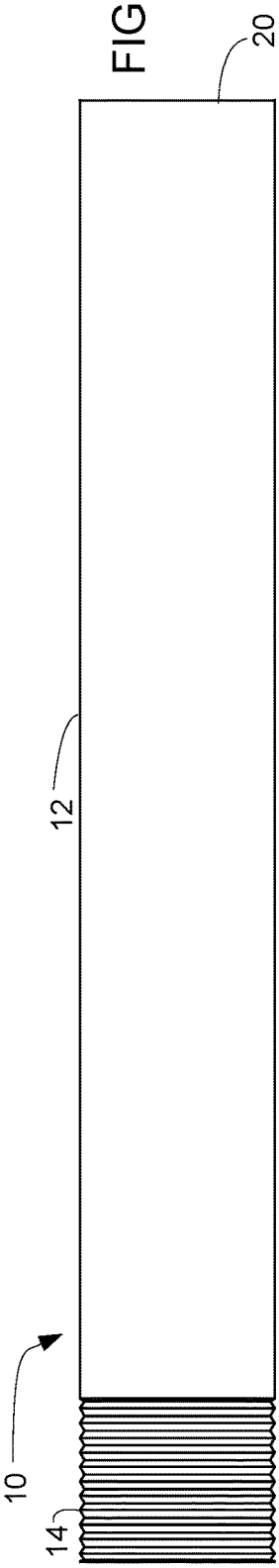
FIG. 8 shows a bottom view of the drain spout of FIG. 1.

FIGS. 1 to 8 show various side views of a drain spout 10 for transferring various materials from a first barrel to a second barrel according to an exemplary embodiment of the invention. As illustrated, the drain spout 10 includes a hollow tubular structure referred to herein as a tubular body 12. The tubular body 12 may be formed by a length of brass pipe with threads 14 on a first end 16 and a notched-out spout section 18 on the second end 20. The threads 14 allow attachment of the first end 16 to a first bunghole on a first barrel, and the notched-out section 18 on the second end 20 acts as a spout for draining material from the first barrel into a second barrel.

The notched out section 18 beneficially helps liquid materials flow from the second end 20, and the notched out end 18 also beneficially ensures the drain spout 10 has a unique appearance and can be recognized by labourers as the tool for transferring fluids barrel to barrel. This helps prevent workers from utilizing the drain spout 10 for other purposes which may then make it unavailable when needed.

FIGS. 9 to 15 illustrates a method of draining material from a first barrel 30 to a second barrel 40 utilizing the drain spout 10 of FIG. 1 according to an exemplary embodiment. The barrels 30, 40 may be fifty-five gallon barrels and the material may be spray foam, for example. The steps illustrated in FIGS. 9 to 15 may be performed by one or more workers on-site attaching the drain spout 10 to a first of the barrels 30, and then positioning, lifting tiling, and rotating the barrel(s) 30, 40 as illustrated. It is to be noted that the steps as illustrated are not restricted to the exact order shown, and, in other configurations, shown steps may be omitted or other intermediate steps added.

Figure 10:
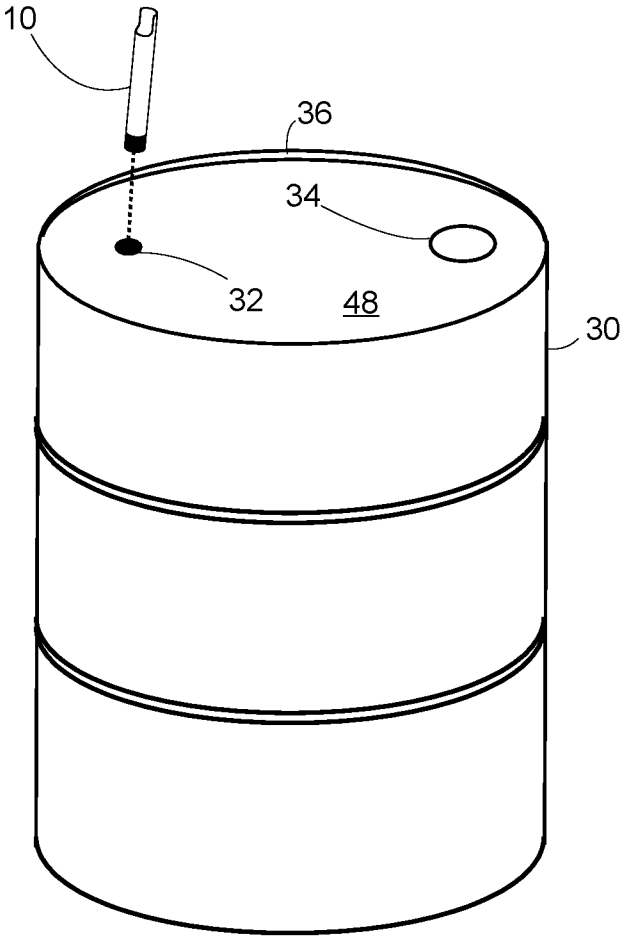
FIG. 10 illustrates a perspective side view of the draining barrel while attaching the drain spout of FIG. 1 to the small bunghole in an exemplary method of utilizing the drain spout.
Figure 9:
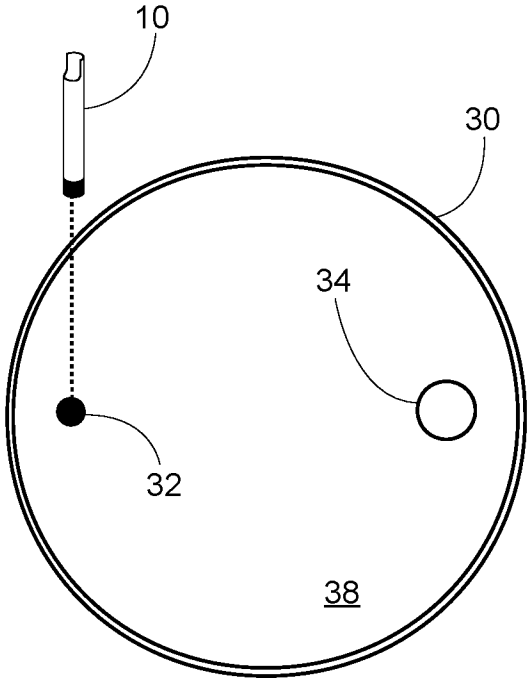
FIG. 9 illustrates a top view of a draining barrel while attaching the drain spout of FIG. 1 to a small bunghole in an exemplary method of utilizing the drain spout.

As shown in FIGS. 9 and 10, the process begins at a first step where a worker screws the drain spout 10 into the small bunghole 32 of a first barrel 30. The first barrel 30 is typically the barrel that only has a small amount of material remaining therein, and this first barrel 30 is referred to herein as the "draining barrel" 30. The smaller bunghole 32 of the draining barrel 30 is open in order to accept the drain spout 10 while the larger bunghole 34 of the draining barrel 30 is sealed such as utilizing a plug or other known means.

Figure 11:
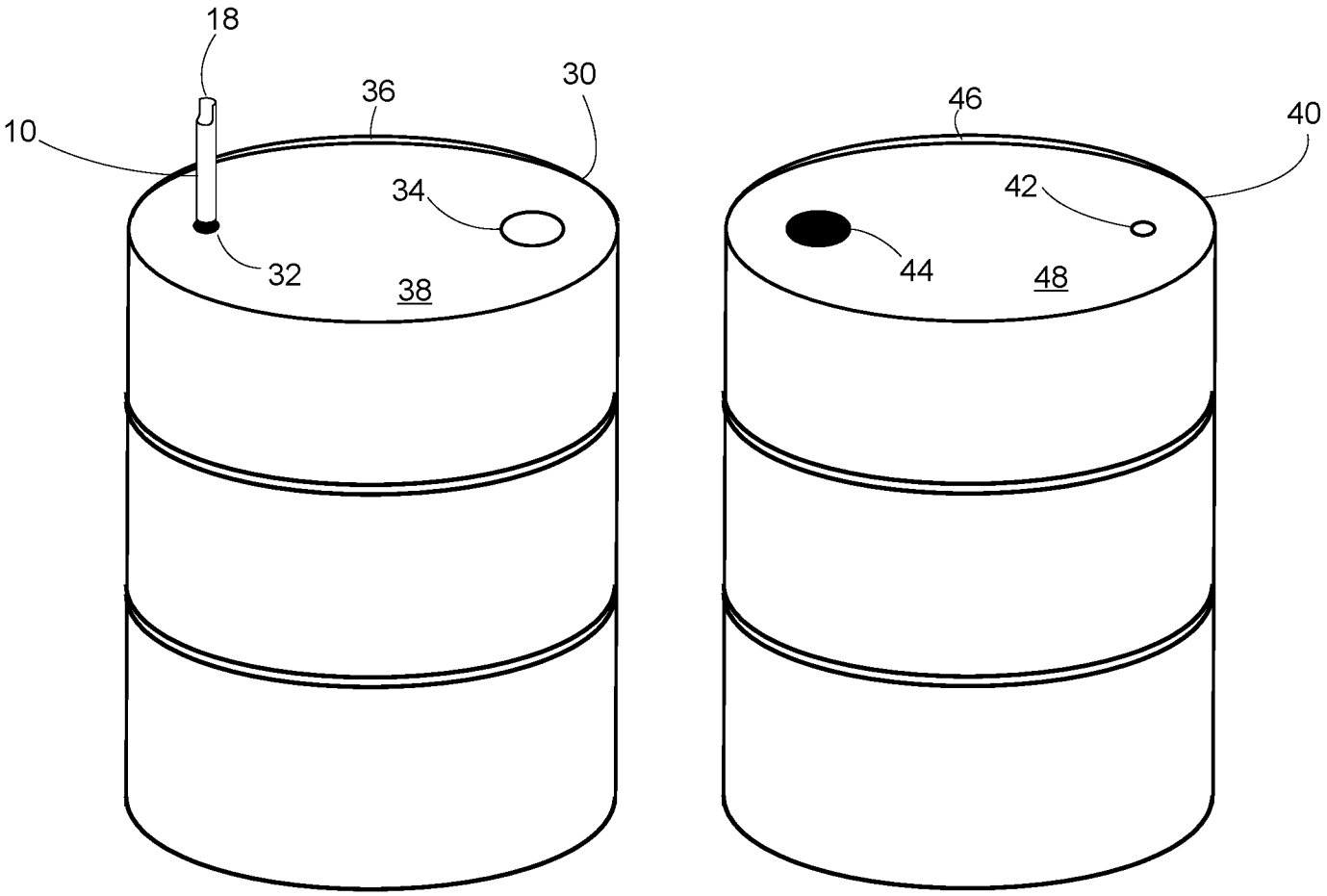
FIG. 11 illustrates a perspective side view of the draining barrel with drain spout attached being positioned beside a catch barrel such that the two barrels' bungholes are symmetrically aligned across from one another according to an exemplary method of utilizing the drain spout.

As shown in FIG. 11, a next step of the process involves aligning the draining barrel 30 beside the second barrel 40. As illustrated, the second barrel also as a smaller bunghole 42 and a larger bunghole 44, and the two barrels are aligned with the smaller bungholes 32, 42 of the two barrels on the outside and the two larger bungholes 34, 44 of the two barrels side by side (adjacent one another). In this way, the two barrels 30, 40 are positioned beside each other such that the barrels' 30, 40 bungholes 32, 34, 42, 44 are symmetrically aligned across from one another. Both barrels in this example further include upper lips 36, 46 around their top surface 38 perimeters.

The second barrel 40 is the barrel that is to be filled with material and is referred to herein as the "catch barrel" 40. As illustrated, the larger bunghole 44 of the catch barrel 40 is opened in order to later accept the spout end 18 of the drain spout 10 and have the material flow into the catch barrel 40 through the larger bunghole 44. In this example, the smaller bunghole 42 of the catch barrel 40 is closed; however, the closed/open state of the smaller bunghole 42 of the catch barrel 40 is optional in this example.

Figure 12:
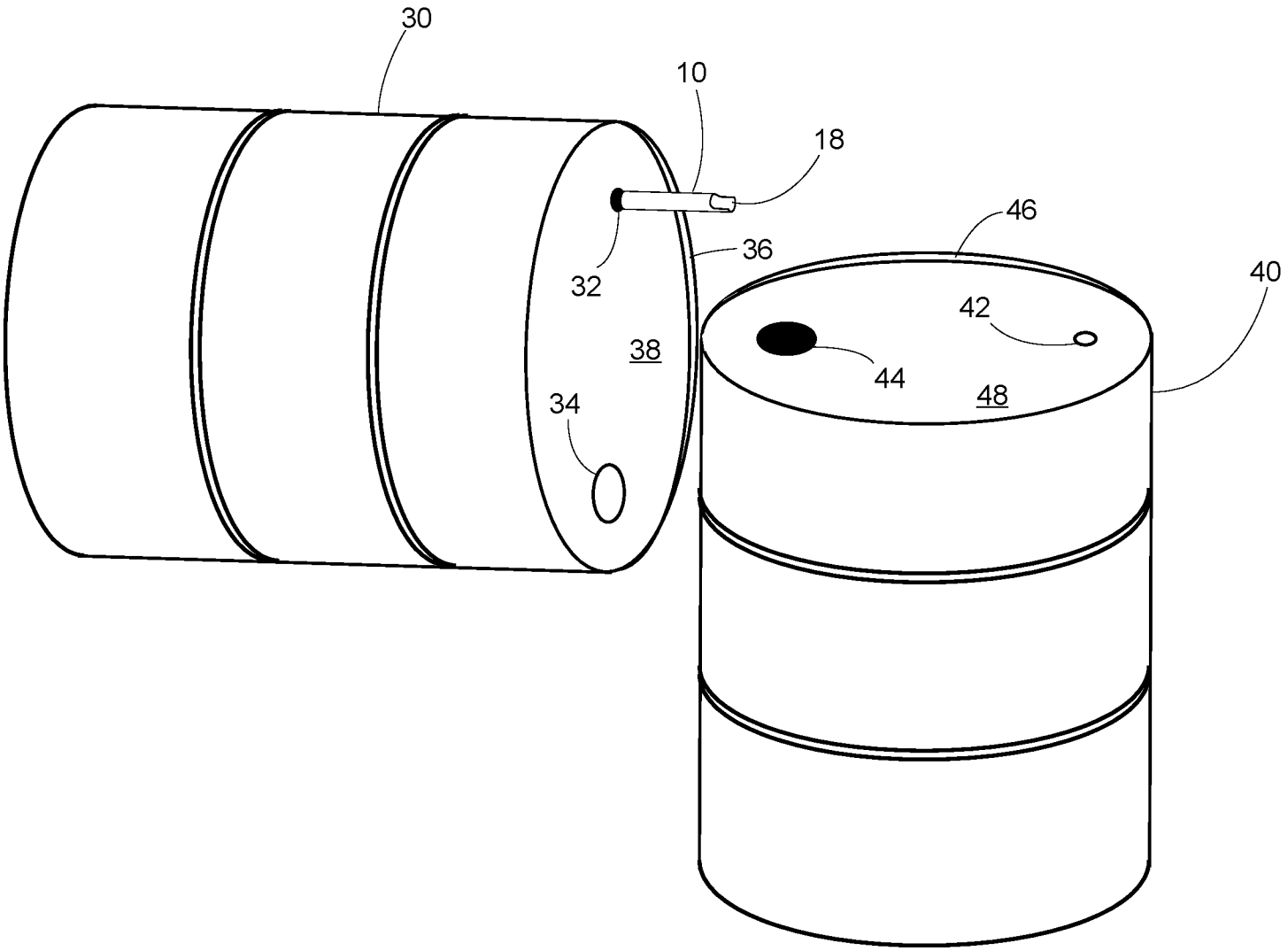
FIG. 12 illustrates a first perspective side view of the barrels showing a step of lifting and tilting the draining barrel such that the drain spout attached to the draining barrel is directed toward the open larger bunghole of the catch barrel according to an exemplary method of utilizing the drain spout.
Figure 13:
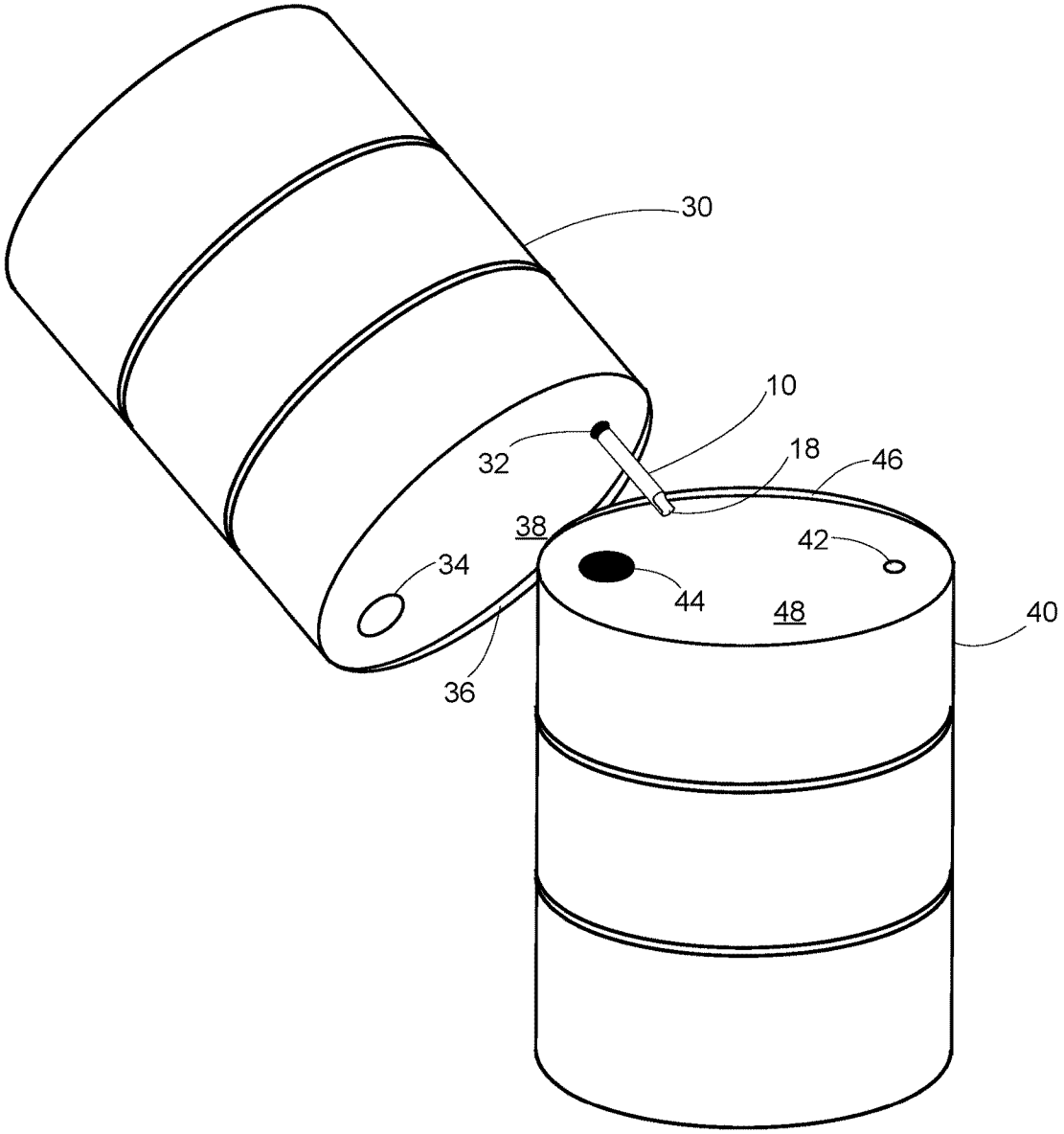
FIG. 13 illustrates a second perspective side view of the barrels showing the step of lifting and tilting the draining barrel such that the drain spout attached to the draining barrel is directed toward the open larger bunghole of the catch barrel according to an exemplary method of utilizing the drain spout.
Figure 14:
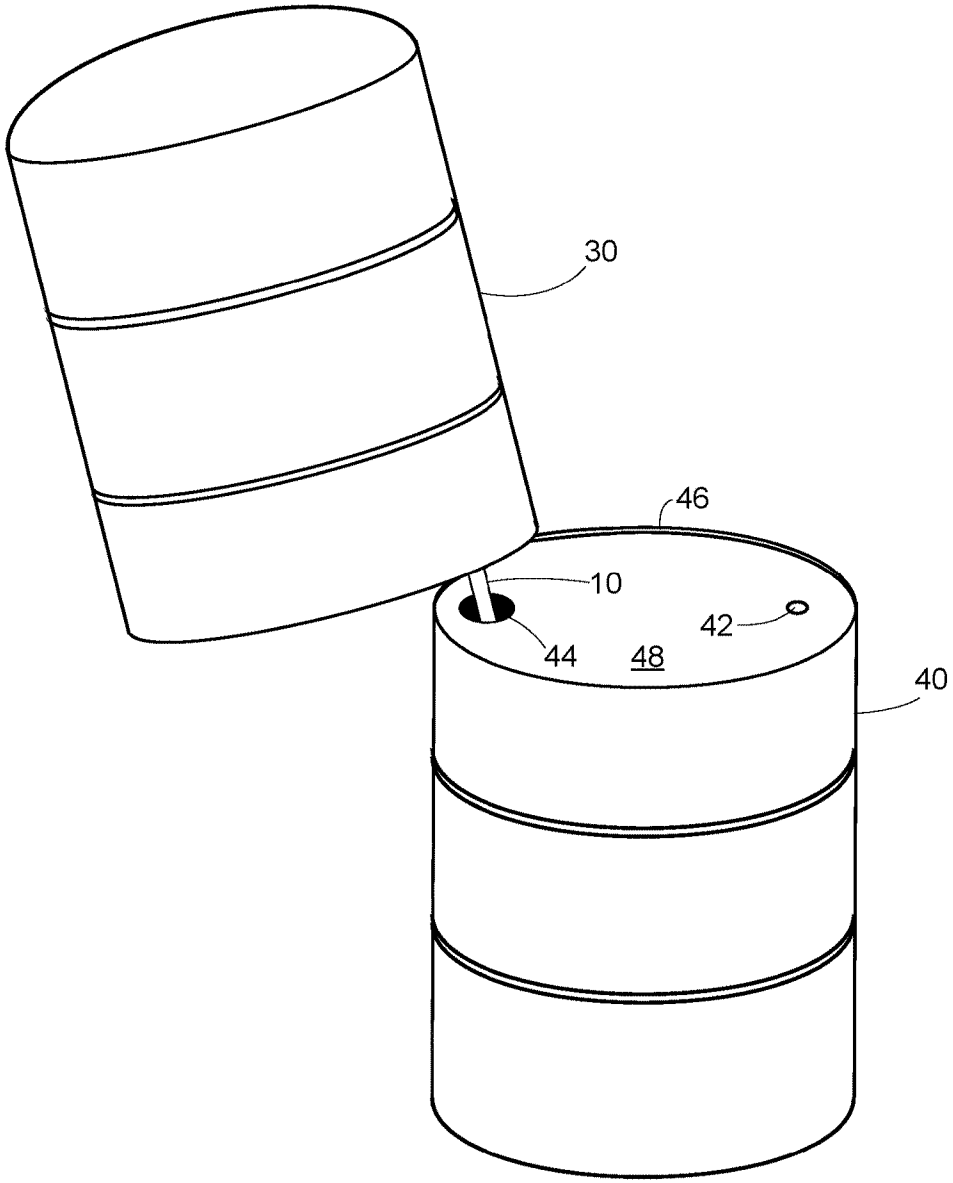
FIG. 14 illustrates a perspective side view of the barrels showing a step of inserting the drain spout attached to the small bunghole of the draining barrel into the larger bunghole of the catch barrel according to an exemplary method of utilizing the drain spout.

As shown in FIGS. 12-14, a next step of the process involves tilting the draining barrel 30 with the drain spout 10 towards the catch barrel 40 and lifting the bottom of the draining barrel 30. As the draining barrel 30 is lifted, the process involves inserting the second end (i.e., spout end 18) of the drain spout 10 into the larger bunghole 44 of the catch barrel 40.

Figure 15:
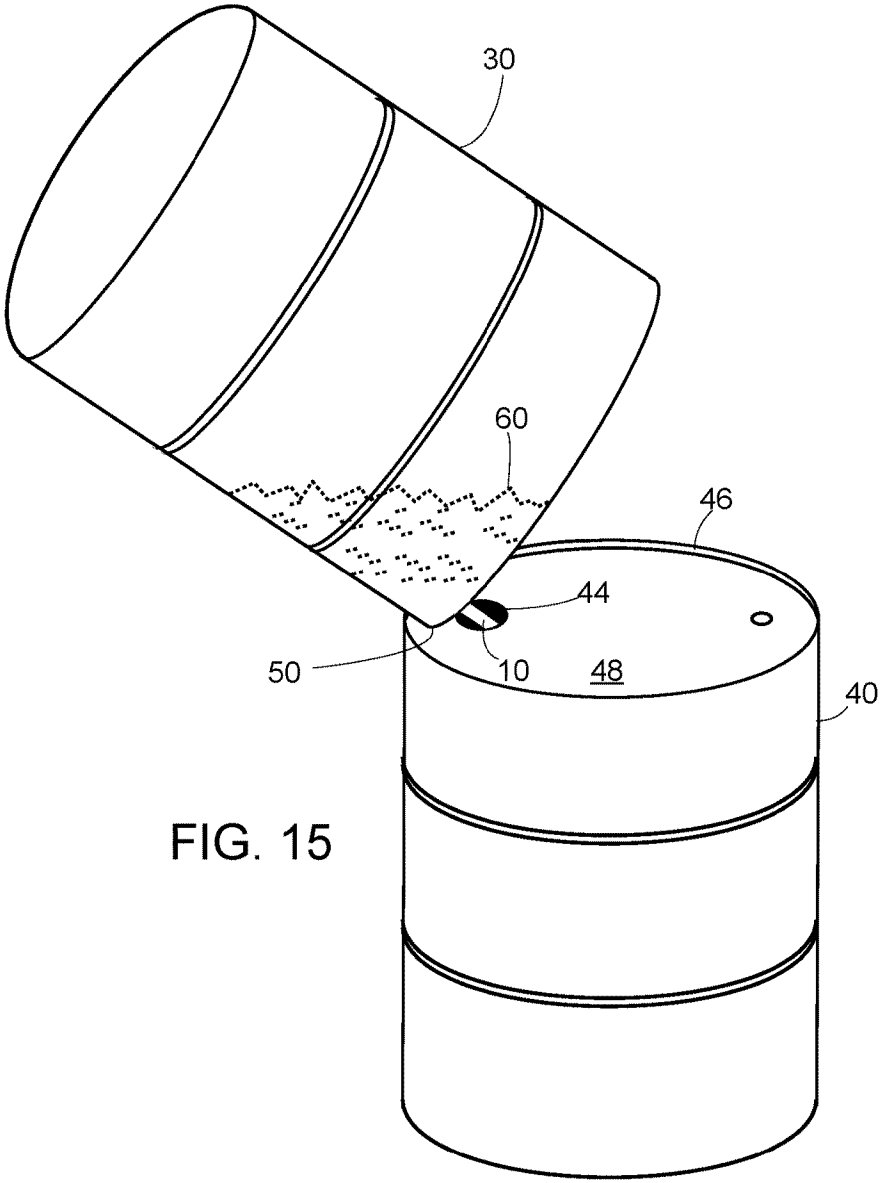
FIG. 15 illustrates a perspective side view of the barrels showing a step of rotating the draining barrel around the drain spout such that the draining barrel is held captive in position by an upper lip of the catch barrel and the drain spout within the larger bunghole of the catch barrel according to an exemplary method of utilizing the drain spout.

As shown in FIG. 15, the process then involves rotating the draining barrel 30 around the drain spout 10 acting as an axis of rotation approximately one-hundred and eighty degrees (180 degrees) until the upper lips 36, 46 of both barrels 30, 40 meet. In particular, the rotation of the draining barrel 30 is performed until a point of contact 50 of an upper lip 36 of the draining barrel 30 closest to the drain spout 10 meets a top surface 48 of the catch barrel 40 adjacent the upper lip 36 of the catch barrel 40. The lip 36 of the draining barrel 30 at the point of contact 50 acts as a corner that frictionally holds against the top surface 48 of the catch barrel 40.

The process then involves letting the draining barrel 30 lean back and start draining. At this point, the draining barrel 30 is frictionally held in position on the catch barrel 40 such as being held by the upper lip 46 of the catch barrel 40 and the drain spout 10 within the larger bunghole 44 of the catch barrel 40. The worker(s) may leave the barrels 30, 40 balanced in the illustrated position while draining material 60 from the draining barrel 30 to the catch barrel 40. During this period of time, the worker(s) may perform other work and there is no need for them to hold up the barrels 30, 40 as illustrated in FIG. 15—gravity and the rigid drain spout 10 in combination with friction stabilize the barrels 30, 40 and hold them in the position illustrated in FIG. 15.

The dotted lines in FIG. 15 show how the remaining fluid material 60 inside the draining barrel 30 will over time pool due to gravity in the bottom corner adjacent the drain spout 10 as a result of the barrels 30, 40 being held in the illustrated position. The remaining fluid 60 will thereby drain via the drain spout 10 from the draining barrel 30 to the catch barrel 40.

Figure 16:
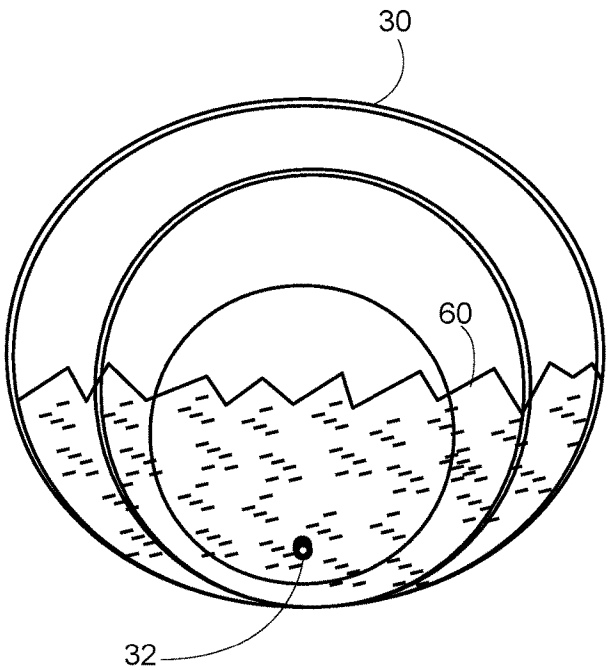
FIG. 16 illustrates an interior view of the draining barrel of FIG. 15 where remaining fluid within collects above the drain spout for draining via the drain spout into the catch barrel.

FIG. 16 illustrates the interior of the draining barrel 30 as seen looking down toward the pooled fluid material 60. As shown, the unused liquid material 60 within the draining barrel 30 collects in the bottom corner and drains out the small bunghole 32 to which the drain spout 10 is secured. Depending on the density of the material 60, the draining process may take a long time and thus one benefit of this embodiment of drain spout 10 and associated method is that they can be rapidly deployed by one or more workers and then the two barrels 30, 40 can be left alone for an extended period of time for the draining process to complete. As illustrated in FIG. 15, the top, draining barrel 30 is securely held above the bottom, catch barrel 40. It is beneficially not required that a worker hold the top barrel 30 steady and it is further beneficial that no complicated and bulky frame structure need to be installed above the catch barrel 40 in order to hold the top barrel 30 in position for long draining times.

Advantages of the drain spout 10 and process of draining materials disclosed herein according to exemplary embodiments include limiting people power requirements and associated labor costs as well as improving material 60 recovery.

Although the invention has been described in connection with preferred embodiments, it should be understood that various modifications, additions and alterations may be made to the invention by one skilled in the art without departing from the spirit and scope of the invention.

For example, an additional feature may include a safety cable for securing the two barrels 30, 40 together such that if the top barrel 30 should fall, it will stay attached to the bottom barrel 40.

Although the above described method works well when the barrels include top lips 36, 46, the top lips are not a requirement and the frictional forces of any corner edge of the draining barrel 30 on the top surface 48 can also be sufficient to hold the two barrels in the position of FIG. 15 without requiring or utilizing the lips 36, 46.

The width of the drain spout 10, tubular body 12 and threads 14 may be modified in different embodiments to correspond with and mate with the smaller bungholes 32, 42 of any sized barrel 30, 40.

Figure 17:
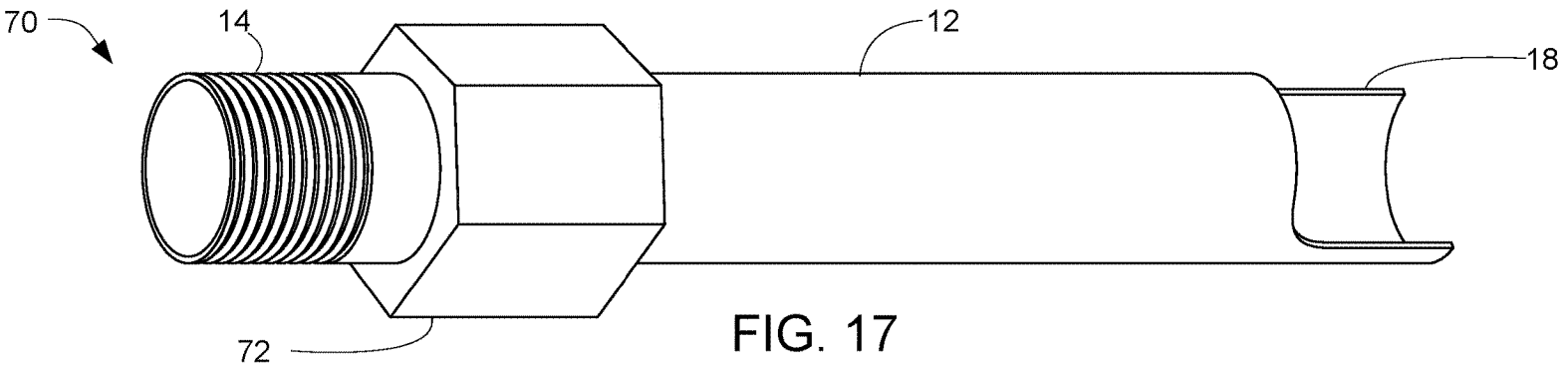
FIG. 17 illustrates a drain spout having an integrated hex bolt head around a perimeter of the tubular body adjacent the threads according to an exemplary embodiment.

In yet another example modification, the drain spout 10 may include a hex bolt head around the outer perimeter of the body adjacent the threads. FIG. 17 illustrates a drain spout 70 having an integrated hex bolt head 72 around a perimeter of the tubular body 12 adjacent the threads 14 according to an exemplary embodiment. This hex bolt head 72 facilitates a worker utilizing a pipe wrench or monkey wrench for tightening the drain spout 70 onto the small bunghole 32 of the draining barrel 30.

Figure 18:
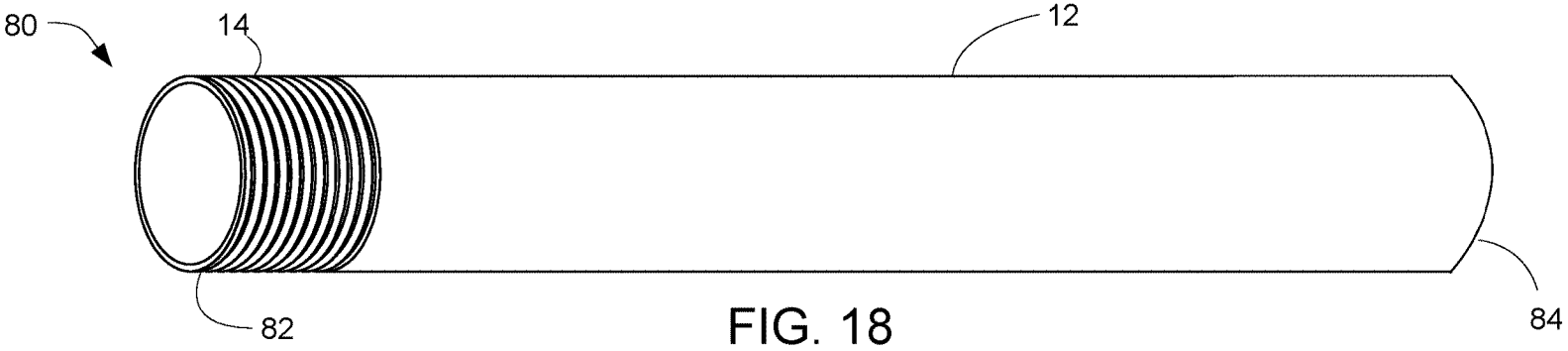
FIG. 18 illustrates a drain spout having tubular body with a threaded first end and a cylindrical second end without any notched-out spout on the second end according to an exemplary embodiment.

Although the shape of the notched-out spout opening 18 as illustrated above facilities pouring and visual recognition of the drain spout tool 10, 70 by workers, the notched-out spout 18 may be omitted in other embodiments. For example, FIG. 18 illustrates a drain spout 80 having tubular body 12 with a threaded first end 82 and a cylindrical second end 84 without any notched-out spout 18 on the second end 84 according to an exemplary embodiment. In this embodiment, the drain spout 80 is modified to only have threads 14 on one end; therefore, any section of pipe with threads 14 on at least one end 82 may act as a drain spout 80 and be utilized in the process described herein for transferring material from one barrel 30 to another barrel 40.

Figure 19:
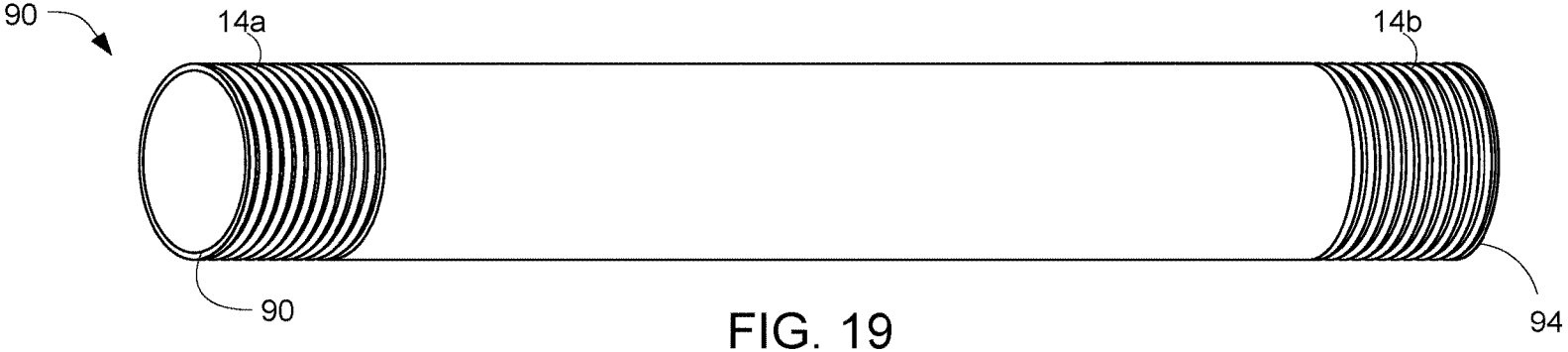
FIG. 19 illustrates a drain spout having a tubular body with a threaded first end and a threaded second end according to an exemplary embodiment.

FIG. 19 illustrates a drain spout 90 with dual end threads 14*a*, 14*b* according to an exemplary embodiment of the invention. In this embodiment, rather than having different shaped first and second ends, as illustrated above in FIGS. 1 to 18, the drain spout 90 of FIG. 19 is symmetrical and includes threads on both ends 92, 94. This beneficially allows the drain spout 90 to be installed to the smaller bunghole 32 of the draining barrel 30 in either direction.

Functions of single units may be separated into multiple units, or the functions of multiple units may be combined into a single unit. All combinations and permutations of the above described features and embodiments may be utilized in conjunction with the invention.

What is claimed is:

1. A method of transferring a material from a draining barrel to a catch barrel utilizing a drain spout comprising a tubular body leading from a first opening to a second opening, and a plurality of threads around an outside of the tubular body adjacent the first opening for engaging with a first bunghole of the draining barrel, each of the draining barrel and the catch barrel having a smaller bunghole and a larger bunghole on their upper surfaces, the method comprising:

screwing the threads of the drain spout into the smaller bunghole on the draining barrel;

positioning the draining barrel beside the catch barrel such that the larger bunghole of the draining barrel is adjacent the larger bunghole of the catch barrel;

inserting the second end of the drain spout into the larger bunghole of the catch barrel by lifting the draining barrel upwards and tilting the draining barrel toward the catch barrel such that the second end of the drain spout enters the larger bunghole of the catch barrel;

while the drain spout is within the larger bunghole of the catch barrel, rotating the draining barrel around the drain spout acting as an axis of rotation approximately one-hundred and eighty degrees until a point of contact of a corner of the draining barrel closest to the drain spout meets a top surface of the catch barrel; and leaning the draining barrel back on the point of contact such that the draining barrel is held in position by an upper lip of the catch barrel and the drain spout within the larger bunghole of the catch barrel while draining material from the draining barrel to the catch barrel.

2. The method of claim 1, wherein the draining barrel and the catch barrel are fifty-five gallon barrels.

3. The method of claim 1, wherein the material is spray foam.

4. The method of claim 1, further comprising forming the drain spout with a spout at the second opening.

5. The method of claim 4, further comprising forming the spout by a notched out section of the tubular body such that a cross section of the tubular body within the notched out section has a C-shape.

6. The method of claim 1, wherein the tubular body at the second opening does not have threads therearound.

7. The method of claim 1, wherein a first shape of the tubular body at the first opening is different than that of a second shape of the tubular body at the second opening.

8. The method of claim 1, wherein the tubular body is substantially cylindrical.

9. The method of claim 1, wherein the tubular body includes a hexagonal bolt head around at least a portion of a perimeter of the tubular body.

10. The method of claim 1, wherein the tubular body is made by a length of a brass pipe.

11. The method of claim 1, wherein the tubular body is symmetrical and includes threads around the outside adjacent both the first opening and second opening.

* * * * *